US005086955A

United States Patent [19]

Anglen

[11] Patent Number: 5,086,955

[45] Date of Patent: Feb. 11, 1992

[54] LOG MARKING APPARATUS

[76] Inventor: Connie I. Anglen, 520720 Sagebrush Ln., Prineville, Oreg. 97754

[21] Appl. No.: 663,682

[22] Filed: Mar. 4, 1991

[51] Int. Cl.[5] ..... B65D 83/14

[52] U.S. Cl. ..... 222/402.150; 222/611.1; 222/473; 222/474; 239/375; 401/193

[58] Field of Search ..... 222/174, 611.1, 323, 222/402.15, 465.1, 470–474; 239/375; 401/193

[56] References Cited

U.S. PATENT DOCUMENTS

| | | | |
|---|---|---|---|
| 2,041,022 | 5/1936 | Rassmussen | 401/193 X |
| 2,720,422 | 10/1955 | Mercur | 222/471 X |
| 3,007,613 | 11/1961 | Tygard | 222/402.15 |
| 3,359,590 | 12/1967 | Perillo | 401/193 |
| 3,510,028 | 5/1970 | Batistelli | 222/174 |
| 3,549,059 | 12/1970 | Sloan | 222/402.15 |
| 3,659,791 | 5/1972 | Clark | 222/474 X |
| 4,040,543 | 8/1977 | Guillen | 222/473 |
| 4,098,436 | 7/1978 | Kohlbeck | 222/474 X |
| 4,169,173 | 9/1979 | Bergholm et al. | 427/284 |
| 4,932,565 | 6/1990 | Paradiso | 222/174 |

FOREIGN PATENT DOCUMENTS

| | | | |
|---|---|---|---|
| 721162 | 5/1942 | Fed. Rep. of Germany | 401/193 |

*Primary Examiner*—Kevin P. Shaver
*Attorney, Agent, or Firm*—Leon Gilden

[57] ABSTRACT

An apparatus wherein an elongate support rod includes an extension leg to underlie and secure a pressurized spray can thereon. A mounting tube receives the spray can nozzle therewithin, wherein a spaced second support rod arranged parallel to and overlying the first support rod mounts an actuator plate therewithin, whereupon pivotment of the actuator plate effects a spray from the spray can nozzle to an underlying log member, wherein a measuring tube is orthogonally arranged relative to and adjacent a lower terminal end of the mounting tube and telescopingly mounts measuring tube extension thereon, wherein the measuring tube extension includes a plate member orthogonally directed relative to and extending below the measuring tube extension to provide an abutment for a forward terminal end of the log member.

6 Claims, 3 Drawing Sheets

LOG MARKING APPARATUS

BACKGROUND OF THE INVENTION

1. Field of the Invention

The field of invention relates to spray apparatus, and more particularly pertains to a new and improved log marking apparatus for indication of a cutting line.

2. Description of the Prior Art

Cutting of logs to predetermined lengths is required as contemporary stoves and fireplaces are constructed to accommodate logs of such predetermined lengths. Cutting of logs of a lesser length effects an inefficiency in use of a stove or fireplace compartment, wherein cutting of logs to a greater length prevents such logs from being inserted within an appropriate fireplace or stove compartment. Examples of the prior art include U.S. Pat. No. 4,579,258 to Brown, et al. wherein a handle member actuates an "L" shaped lever, wherein the "L" shaped lever extends in a position to overlie a horizontal extent of the handle and an aerosol actuator cap to effect release of spray from the aerosol container.

U.S. Pat. No. 4,089,440 to Lee sets forth a generally "C" shaped mounting handle with a lever pivotally mounted to and extending above the handle of an overlying aerosol cap. The instant invention overcomes deficiencies of such prior art by providing a completely enclosed handle minimizing damage to the handle during use in a log marking procedure.

U.S. Pat. No. 4,432,474 to Hutchinson sets forth a further example of a clamp organization to secure and clamp an aerosol container within a handle, with an actuator lever positioned to overlie the aerosol cap.

U.S. Pat. No. 4,660,745 to Hess, Jr. sets forth a further example of a handle structure to secure and selectively actuate an aerosol container.

As such, it may be appreciated that there continues to be a need for a new and improved log marking apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of marking apparatus now present in the prior art, the present invention provides a log marking apparatus wherein the same provides for an aerosol container selectively actuated to provide visual marking of a log prior to a log cutting procedure. As such, the general purpose of the present invention, which will be described subsequently in greater detail, is to provide a new and improved log marking apparatus which has all the advantages of the prior art marking apparatus and none of the disadvantages.

To attain this, the present invention provides an apparatus wherein an elongate support rod includes an extension leg to underlie and secure a pressurized spray can thereon. A mounting tube receives the spray can nozzle therewithin, wherein a spaced second support rod arranged parallel to and overlying the first support rod mounts an actuator plate therewithin, whereupon pivotment of the actuator plate effects a spray from the spray can nozzle to an underlying log member, wherein a measuring tube is orthogonally arranged relative to and adjacent a lower terminal end of the mounting tube and telescopingly mounts a measuring tube extension thereon, wherein the measuring tube extension includes a plate member orthogonally directed relative to and extending below the measuring tube extension to provide an abutment for a forward terminal end of the log member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing description is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The description is neither intended to define the invention of the application, which is measured by the claims, nor is it intended to be limiting as to the scope of the invention in any way.

It is therefore an object of the present invention to provide a new and improved log marking apparatus which has all the advantages of the prior art marking apparatus and none of the disadvantages.

It is another object of the present invention to provide a new and improved log marking apparatus which may be easily and efficiently manufactured and marketed.

It is a further object of the present invention to provide a new and improved log marking apparatus which is of a durable and reliable construction.

An even further object of the present invention is to provide a new and improved log marking apparatus which is susceptible of a low cost of manufacture with regard to both materials and labor, and which accordingly is then susceptible of low prices of sale to the consuming public, thereby making such log marking apparatus economically available to the buying public.

Still yet another object of the present invention is to provide a new and improved log marking apparatus which provides in the apparatuses and methods of the prior art some of the advantages thereof, while simultaneously overcoming some of the disadvantages normally associated therewith.

Still another object of the present invention is to provide a new and improved log marking apparatus wherein the same provides simultaneous measuring and spray application of a marking device to provide indication of a position on an associated log to sever the same.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
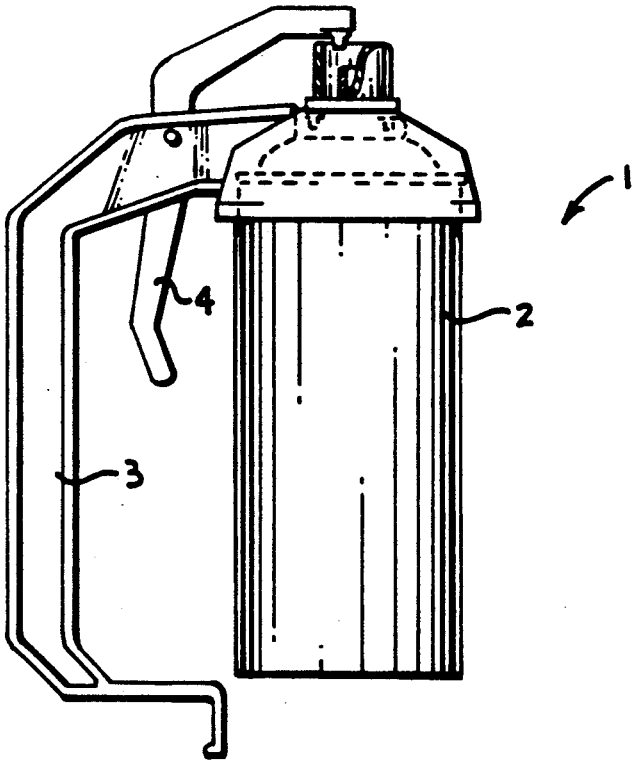
FIG 1 PRIOR ART
FIG. 1 is an orthographic side view of a prior art marking apparatus utilizing an aerosol container.
Figure 2:
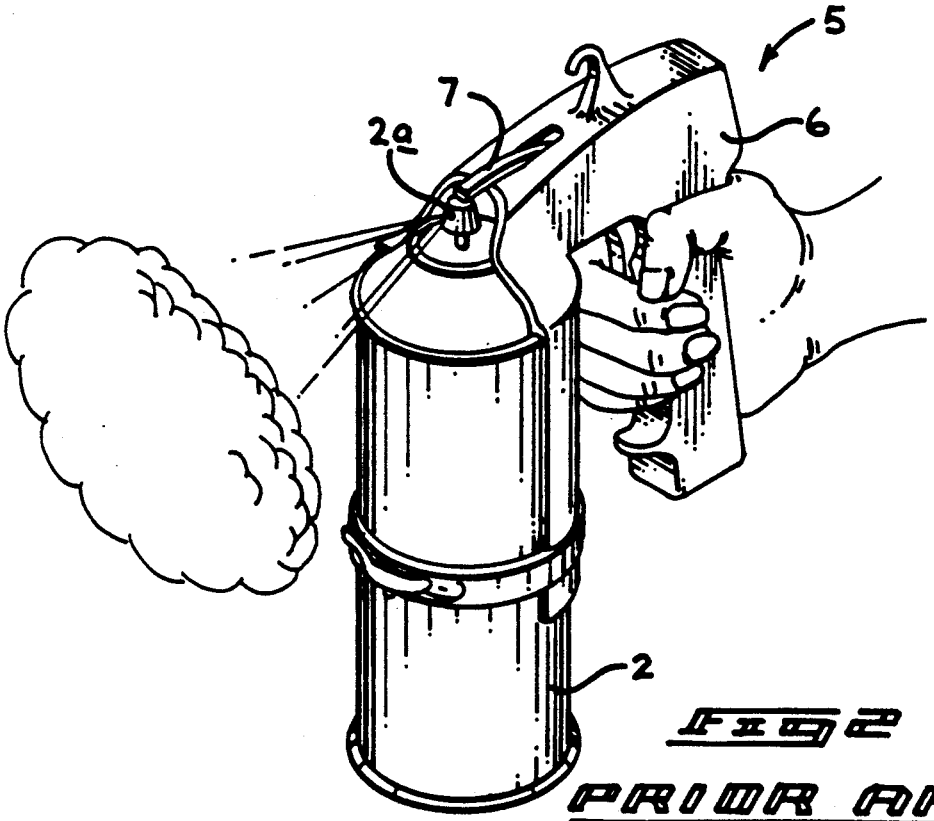
FIG 2 PRIOR ART
FIG. 2 is an isometric illustration of a further prior art marking apparatus utilizing an aerosol spray can.

With reference now to the drawings, and in particular to FIGS. 1 to 5 thereof, a new and improved log marking apparatus embodying the principles and concepts of the present invention and generally designated by the reference numeral 10 will be described.

FIG. 1 illustrates a prior art marking apparatus 1, wherein an aerosol spray can 2 is mounted to a generally "C" shaped handle 3, wherein an "L" shaped lever 4 is directed through and projects above the "C" shaped support to effect selective actuation of the spray can 2 contained within the organization, as set forth in U.S. Pat. No. 4,089,440. Similarly, U.S. Pat. No. 4,579,258 sets forth a marking apparatus 5, wherein a handle 6 includes a projecting lever 7 to depress a spray can nozzle 2*a* of an associated aerosol container 2.

Figure 3:
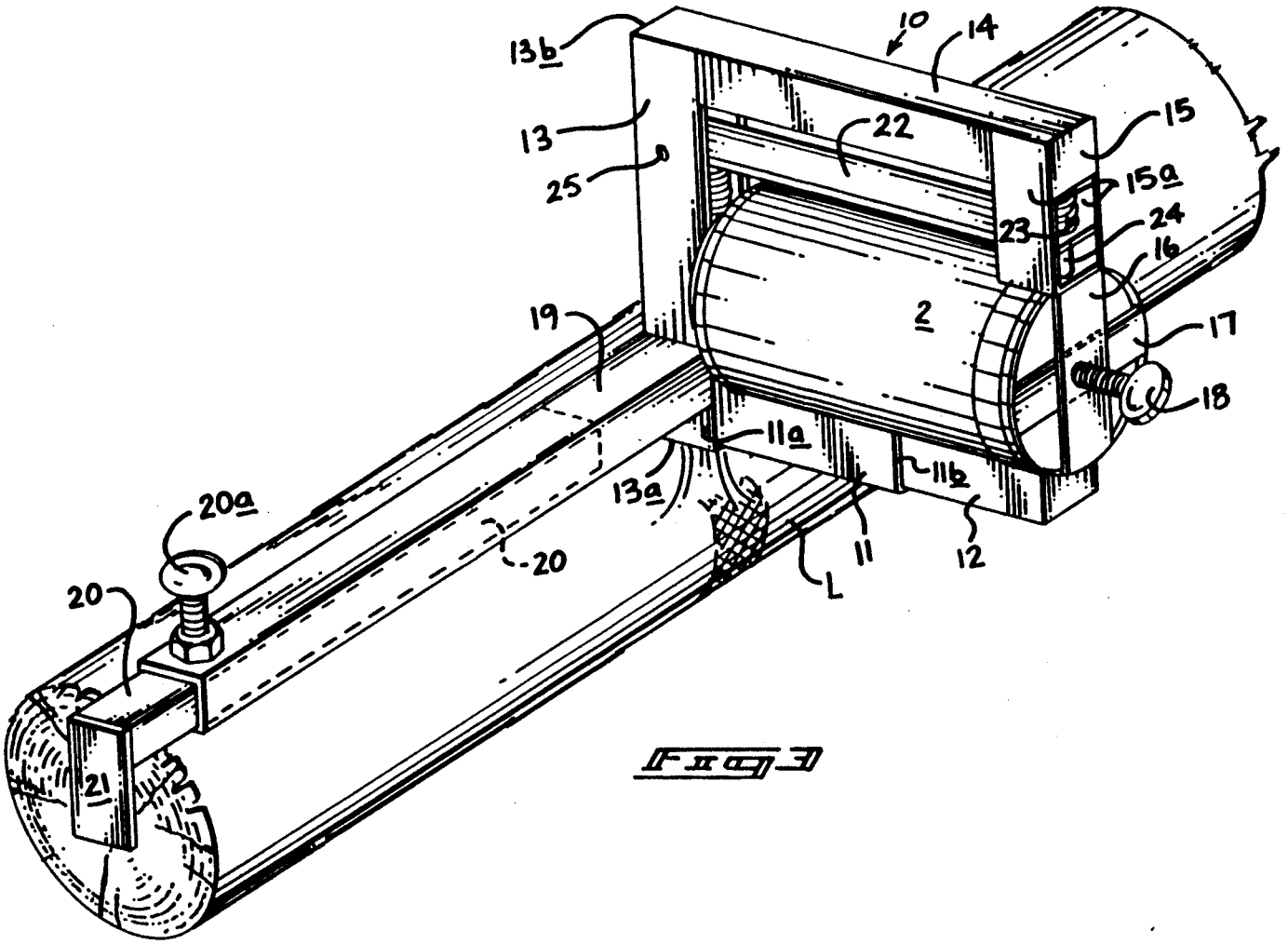
FIG. 3 is an isometric illustration of the instant invention.

More specifically, the log marking apparatus 10 of the instant invention essentially comprises an elongate first support rod 11, including a forward terminal end 11*a* and a rear terminal end 11*b*. An extension rod 12 is frictionally and telescopingly retained within the elongate support rod and underlies an associated pressurized aerosol can 2. The aerosol can 2 includes an aerosol can nozzle 2*a* mounted coaxially to an upper terminal end of the aerosol can nozzle in a conventional manner. The mounting tube 13 is fixedly and orthogonally mounted to the forward terminal end 11*a* of the support rod 11 and includes a lower terminal end 13*a* and an upper terminal end 13*b*. A second elongate support rod 14 is arranged parallel to and overlying the first support rod 11 and is orthogonally mounted to the mounting tube upper terminal end 13. The second support rod 14 includes a second support rod rear plate 15 and second support rod side plates 15*a*. The rear and side plates 15 and 16 respectively capture and receive a return spring 23 therewithin that is mounted interiorly of the rear and side plates and overlying the rear terminal portion of a first actuator plate 22, as illustrated in FIG. 3 for example. The return spring 23 and the rear terminal portion of the first actuator plate 22 includes a positioning rod 24 extending therethrough to align the spring and actuator plate relative to the side plates 15*a*. An extension rod rear plate 16 is orthogonally and integrally mounted to a rear terminal end of the extension rod 12 (see FIGS. 3 and 4 for example) and includes a clamp plate 17 positioned between the bottom surface of the aerosol container 2 and the rear plate 16, with the clamp plate 17 fixedly mounted to a threaded clamp rod 18 that is threadedly directed through the rear plate 16 to clamp the container tube between the rear plate and the mounting tube 13. It is understood that should a clamping device be desired between the extension rod 12 and the first support rod 11, such may be provided to further enhance the secured relationship between the support rod 11 and the extension rod 12.

Figure 4:
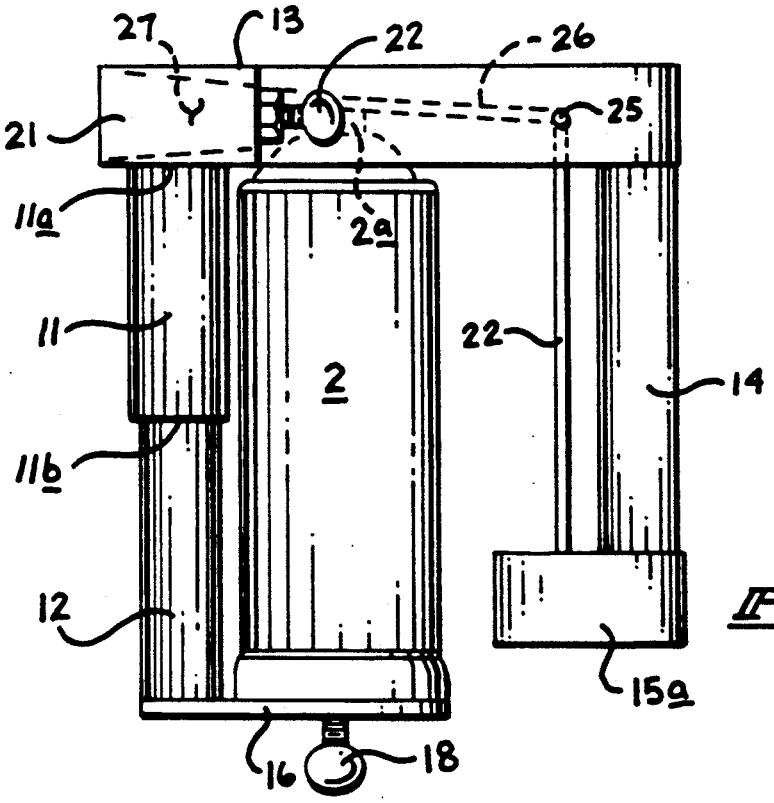
FIG. 4 is an orthographic side view, taken in elevation, of the instant invention.
Figure 5:
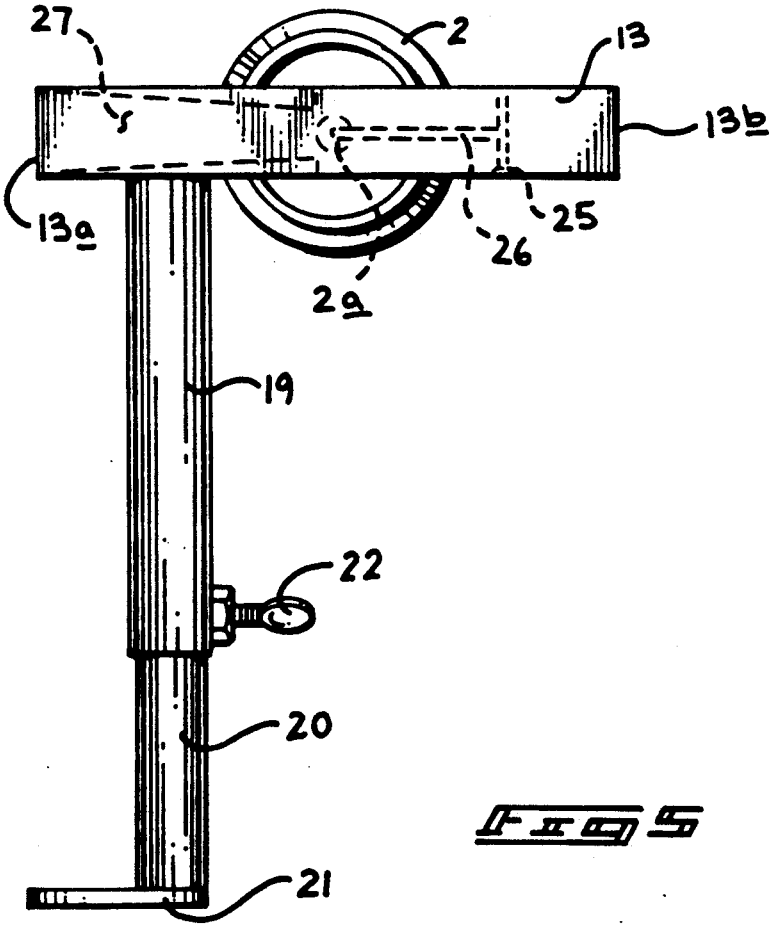
FIG. 5 is an orthographic frontal view, taken in elevation, of the instant invention.

A measuring tube 19 is orthogonally and integrally mounted to the mounting tube 13 adjacent the mounting tube lower terminal end 13*a*. The measuring tube 19 telescopingly receives a measuring tube extension 20 reciprocatably therewithin utilizing an extension tube clamp rod 28 orthogonally directed through the measuring tube 19 to selectively secure the extension 20 relative to the measuring tube 19 in a desired lengthwise relationship in accordance with desired length of log "L" to be measured. A downwardly depending extension plate 21 is orthogonally and integrally mounted to a forward terminal end of the tube extension 20 to provide an abutment to overlie the log "L" as illustrated in FIG. 3. Actuation of the aerosol container 2 to effect directing of a paint spray 28 therefrom includes a second actuator plate 26 integrally mounted at a generally oblique angle to the first actuator plate 22, with the first and second actuator plates 22 and 26 pivoted about their intersection by pivot axle 25 extending between side walls of the mounting tube 13 between the lower and upper terminal ends 13*a* and 13*b* respectively thereof. The second actuator plate 22 includes a forward actuator plate forward end overlying the aerosol container nozzle 2*a*, as illustrated in FIGS. 4 and 5 for example, with a conical spray channel 27 defined within the mounting tube 13 to accommodate and direct a spray from the nozzle 2*a* and thereby provide a pattern, in a manner as illustrated in FIG. 3.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A log marking apparatus comprising, in combination, an elongate support rod, the support rod telescopingly mounting an extension rod, and the extension rod including an extension rod rear plate, and the support rod including a forward terminal end remote from the extension rod rear plate, with a mounting tube integrally and orthogonally mounted to the elongate support rod at the forward end, and clamp means mounted to the extension rod rear plate to secure an aerosol container between the extension rod rear plate and the mounting tube, and the mounting tube including a mounting tube lower terminal end and a mounting tube upper terminal end, the mounting tube upper terminal end including a further support rod integrally and orthogonally mounted thereto overlying the support rod, and actuator means mounted to the further support rod for permitting depressing of an aerosol container nozzle mounted to the aerosol container, with the aerosol container nozzle positioned within the mounting tube for directing of spray from the aerosol container exteriorly of the mounting tube.

2. An apparatus as set forth in claim 1 including a measuring tube integrally and orthogonally mounted to the mounting tube extending laterally of the mounting tube, and the measuring tube including a measuring tube extension telescopingly mounted therewithin, the measuring tube extension including an extension plate integrally and orthogonally mounted to the measuring tube extension extending below the measuring tube extension to provide an abutment overlying the free end of a log.

3. An apparatus as set forth in claim 2 wherein the clamping means includes an extension rod rear plate integrally and orthogonally mounted to the extension rod spaced from the support rod, and the extension rod rear plate includes a threaded clamp rod threadedly directed orthogonally therethrough, and a clamp plate mounted to the threaded clamp rod between the aerosol container and the extension rod rear plate.

4. An apparatus as set forth in claim 3 wherein the actuator means includes a first actuator plate positioned between the further support rod and the support rod, and the first actuator plate extending coextensively of the further support rod and pivotally mounted within the mounting tube, and a second actuator plate integrally mounted to the first actuator plate defining an oblique angle therebetween, with the second actuator plate overlying the aerosol container nozzle.

5. An apparatus as set forth in claim 4 wherein the further support rod includes a further support rod rear terminal end spaced from the mounting tube, and the further support rod rear terminal end includes a plurality of side walls mounted orthogonally to the further support rod extending towards the extension rod, and a spring member captured between the first actuator plate and the further support rod between the further support rod side walls, and a positioning rod directed through the first actuator plate and the spring member between the side walls to maintain alignment of the first actuator plate between the side walls.

6. An apparatus as set forth in claim 5 including a conical spray channel formed within the mounting tube between the mounting tube lower terminal end and the second actuator plate, with the spray container nozzle positioned in alignment with the conical spray channel.

* * * * *